US008898989B2

(12) United States Patent
Phillips

(10) Patent No.: US 8,898,989 B2
(45) Date of Patent: Dec. 2, 2014

(54) GUSSET BLOCK CONSTRUCTION

(76) Inventor: Thomas E Phillips, Princeton, IL (US)

( * ) Notice: Subject to any disclaimer, the term of this patent is extended or adjusted under 35 U.S.C. 154(b) by 230 days.

(21) Appl. No.: 13/403,546

(22) Filed: Feb. 23, 2012

(65) Prior Publication Data

US 2012/0233935 A1 Sep. 20, 2012

Related U.S. Application Data

(60) Provisional application No. 61/465,026, filed on Mar. 14, 2011.

(51) Int. Cl.

| | |
|---|---|
| ***E04C 1/00*** | (2006.01) |
| ***E04B 2/08*** | (2006.01) |
| *E04B 2/02* | (2006.01) |

(52) U.S. Cl.

CPC ..... *E04B 2/08* (2013.01); *E04B 2002/0219* (2013.01); *E04B 2002/0243* (2013.01)

USPC ..... 52/592.5; 52/578; 52/592.6; 52/586.1

(58) Field of Classification Search

CPC ..... E04B 2/08; E04B 2002/0219; E04B 2002/0254; E04B 2002/0243; E04B 2/06; E04B 2002/0245; E04B 1/48; E04B 2/18; E04B 2002/0206; E04B 2002/0217; E04B 2002/0208; E04F 2201/0153

USPC ..... 52/582.1, 586.1, 585.1, 592.5, 592.6, 52/596, 605, 604

See application file for complete search history.

(56) References Cited

U.S. PATENT DOCUMENTS

| | | | | |
|---|---|---|---|---|
| 2,484,062 | A * | 10/1949 | Abbott | 52/302.4 |
| 4,454,699 | A * | 6/1984 | Strobl | 52/585.1 |
| 5,771,650 | A * | 6/1998 | Williams et al. | 52/568 |
| 7,779,588 | B1 * | 8/2010 | Bruning | 52/297 |
| 8,671,640 | B1 * | 3/2014 | Thomas | 52/586.2 |
| 2002/0152708 | A1 * | 10/2002 | Kimura et al. | 52/596 |
| 2003/0203702 | A1 * | 10/2003 | Germerodt et al. | 446/85 |
| 2009/0113836 | A1 * | 5/2009 | Pitchers et al. | 52/604 |
| 2009/0239441 | A1 * | 9/2009 | Hu | 446/123 |

* cited by examiner

*Primary Examiner* — Brian Glessner
*Assistant Examiner* — Adam Barlow

(57) ABSTRACT

Gusset Block Construction deals with a block that is cored from all sides. The blocks are cubes and elongated cubes with a pyramid or elongated pyramid shaped cavity on each side resulting in a block in which each of the twelve edges is central on a gusset shape extending from said edge to the central axis of the block. With the use of a second octahedron block that fits within the pyramid shaped cavities a wall that requires no fastening can be built by placing octahedrons in the top cavities of a layer of blocks and placing another layer of blocks on it. These blocks will be able to come apart at the joints during an earthquake without completely disassembling and can return to original position when the earthquake stops. They can be molded in a two piece split mold and are scaleable; tapered piers could be made.

5 Claims, 13 Drawing Sheets

GUSSET BLOCK CONSTRUCTION

CROSS REFERENCE TO RELATED APPLICATIONS

Provisional Patent Application No. 61/465,026
Filing Date: Mar. 14, 2011
Name of Applicant: Thomas Phillips
Title of Invention: Construction Block with Feature for Earthquake Survival
Utility Patent Application No. 12/655,690
Filing Date: Jan. 6, 2010
Name of Applicant: Thomas Phillips
Title of Invention: Gusset Plate Construction

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Construction Blocks have been around a long time; they are generally made of concrete and have vertical holes extruded through them. Another common Construction Block is the brick which may or may not have holes extruded through. In general coring of these blocks to conserve material is through the top and bottom; to core the front or back face would require a side core in the mold. Each of these is usually assembled with mortar which requires considerable expertise, time, and labor, to serve as an adhesive and spacer at the joints. This results in a one piece wall which if cracked in an earthquake or other event may fall apart or be in danger of falling apart without major repair.

BRIEF SUMMARY OF THE INVENTION

Gusset Block Construction deals with a construction block that is cored from all sides as opposed to the top and bottom. To be able to do this the block is shaped such that it could be molded in 2 plate split mold that has an axis of movement that is central to the 3 faces of a given corner of the block. The construction blocks are cubes or elongated cubes with pyramid, or elongated pyramid, shaped cavities on each of the 6 sides resulting in a block in which each of the 12 edges is central on a gusset extending from said edge to the center or central axis of the block. With the use of a second octahedron block that fits in the pyramid shaped cavities a wall that requires no fastening can be built by placing octahedrons in the top cavities of a layer of blocks and placing another layer of blocks on it. Further with the use of large tapered blocks and the use of the octahedron block that fits within the pyramid cavity large piers for bridges and other platforms can be built. These assemblies will be able to part at the joints during an earthquake without disassembling completely and if they do come apart may in many cases remain intact and be put back together again. In addition coring the face and back of the block provides a place to nail or screw a block to a block beneath it if desired.

BRIEF DESCRIPTION OF THE SEVERAL VIEWS OF THE DRAWINGS

FIG. 1 shows a basic cube shaped Gusset Construction Block in the front view of the plane it is molded in.

FIG. 3 shows a basic cube shaped Gusset Construction Block with thicker walls and a provision for alignment shown in the front view of the plane it is molded in.

FIG. 6 is shows an elongated cube shaped Gusset Construction Block shown in the front view of the plane it is molded in.

FIG. 9 is an assembly view of a wall made with Gusset Construction Blocks shown in FIG. 3 and FIG. 6; shown in the front view of the plane they were molded in.

FIG. 21 is a view of a solid block with an integral octahedral component shown in the plane it is molded in.

DESCRIPTION OF INVENTION

The Gusset Block Construction system invention is comprised of a cube shaped block cored from all 6 sides; a second block that is the same as the first excepting that it is elongated by a factor of 2, and a 3rd octahedral block that fits within the cored out areas of two cubes stacked together holding them in alignment. In assembly for one block to move horizontally with respect to another it will be required to move apart from it also; Further, in this construction block system, blocks can move vertically and are expected to do so in the event of an earthquake or other forces that encourage separation of blocks, therefore gravity holds the faces of the blocks together and in alignment in the planes perpendicular to earth as well as the plane horizontal to earth, for purposes of this specification, a level floor or footing. The blocks will move apart when forced but will come back together by themselves due to physical configuration and gravity.

Figure 1:
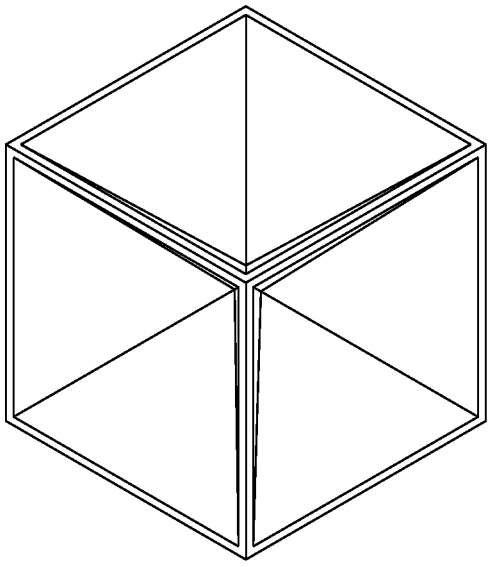
Figure 2:
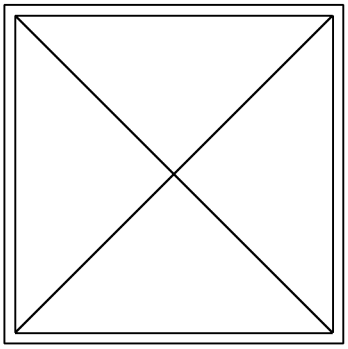
FIG. 2 shows a basic cube shaped Gusset Construction Block as seen from any of 6 equal sides.

On each face of the first said block, the cube shaped block, a square is centrally drawn and this square forms the base of a pyramid facing into the cube from which material is removed. The angle between opposing faces of the said pyramid is to be greater than 90 degrees, the reason being that a two piece split mold can be used to mold the block if the mold movement axis is determined by a line drawn from one corner of the cube and central to the 3 faces of the cube intersecting at said corner, and further to serve as a ramp as will be explained further into this specification. FIG. 1 shows such a cube as molded, and FIG. 2 shows the face of the cube as seen from any of the 6 sides. Note that the axis of movement for the mold halves derived for this block remains the same for the second elongated block yet to be described.

The blocks shown to this point have been thin and might be made of injection molded plastic. They might be suitable for walls for many structures with initial cost of manufacture and assembly being a major consideration and structural integrity lesser so; toys for example or temporary office walls. In the remaining portion of this specification thicker walled blocks will be shown; the basic concepts will remain the same.

Figure 3:
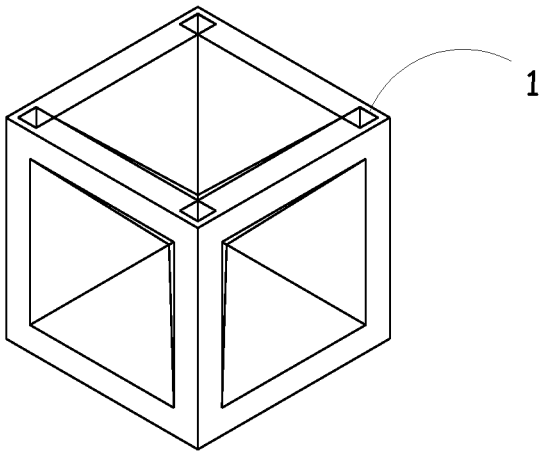
Figure 4:
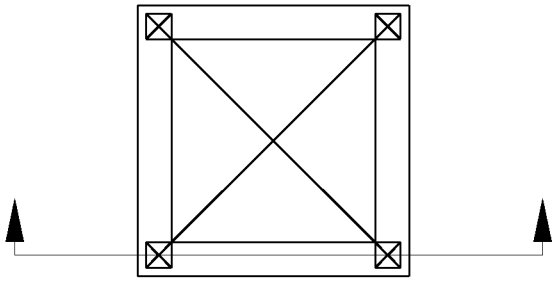
FIG. 4 is a top view of the Gusset Construction Block shown in FIG. 3.
Figure 5:
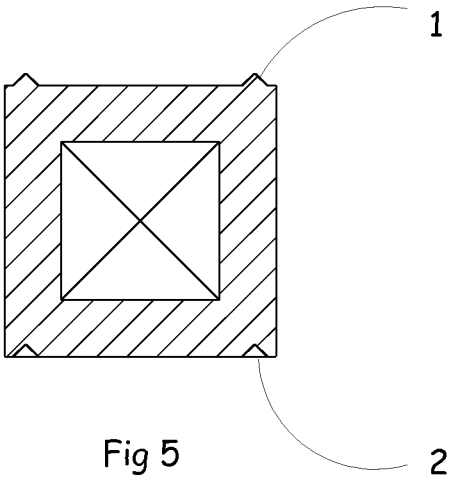
FIG. 5 is a section view taken from FIG. 4.

FIG. 3 is a cube shaped block with a thicker wall and with pyramid shaped projections 1, on it's top face, shown in the plane of molding. FIG. 4 is a view of the top face of the cube shaped block in FIG. 3 and FIG. 5 is a section view of FIG. 4 showing indentations 2, to mate with the projections 1. Note that the angle between the opposing faces, referring to FIG. 3, on pyramid shaped projection 1, is greater than 90 degrees for purposes of draft in molding and also to serve as a ramp for a top block to rise on a block beneath it in the event of horizontal forces such as in an earthquake or a bump from a vehicle.

When a cube shaped block is placed on a level floor on earth and a second cube shaped block stacked on top of it with said projections in said indentations and then a force applied horizontally to said top block, said top block will rise a distance and if said distance is less than the height of said projections then when said force is removed said top block will slide back to its previous position on said bottom block due to gravitational force.

Figure 6:
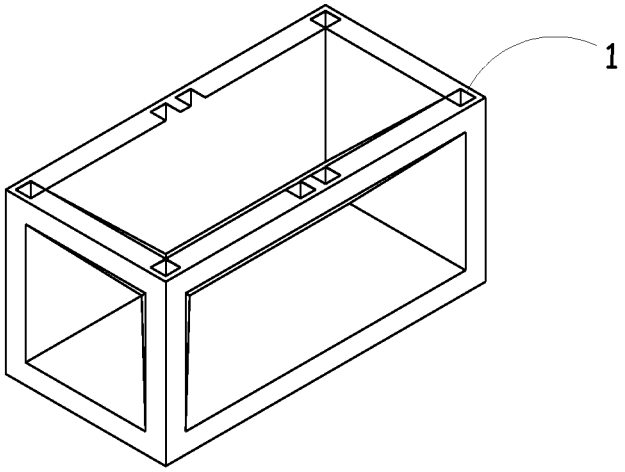
Figure 7:
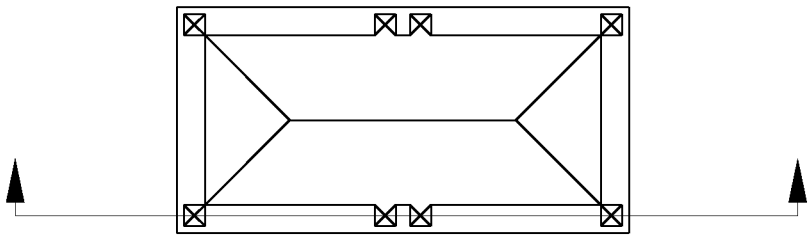
FIG. 7 is a top view of the Gusset Construction Block shown in FIG. 6.

FIG. 6 is the same block as that in FIG. 3 with its length multiplied by a factor of two making the block 2 cube lengths long and one cube length high and wide and with the pattern of projections and indentations mirrored on a vertical plane through the center of the block shown FIG. 7 top view. As previously noted the axis of movement for the mold halves remains the same as was derived from the block shown in FIG. 3. From an outside corner a line is drawn central to the planes of the 3 faces of the block and this line could serve as the axis of movement to mold the block with a 2 plate mold.

Figure 8:
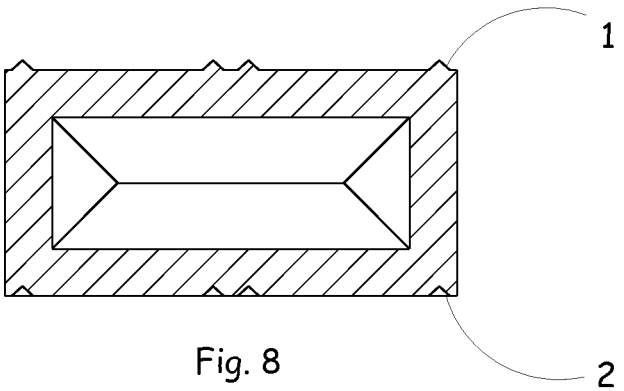
FIG. 8 is a section view taken from FIG. 7

FIG. 7 is a top view of the block in FIG. 6, and FIG. 8 is a section from FIG. 7. Referring to FIG. 3 a pattern of 4 projections, 1, is shown, referring back to FIG. 7, two such patterns exist and it is intended to be obvious that two cube shaped blocks as shown in FIG. 3 could be placed on top of one elongated block as shown in FIG. 8 and that referring to FIGS. 5 and 7 that items 1 and 2 would fit together. Further it seems obvious that the same patterns could be used on other sides; the ends for instance or even the front and back which would perhaps serve no other purpose than to allow assembly using the front face as the top or bottom face.

Figure 9:
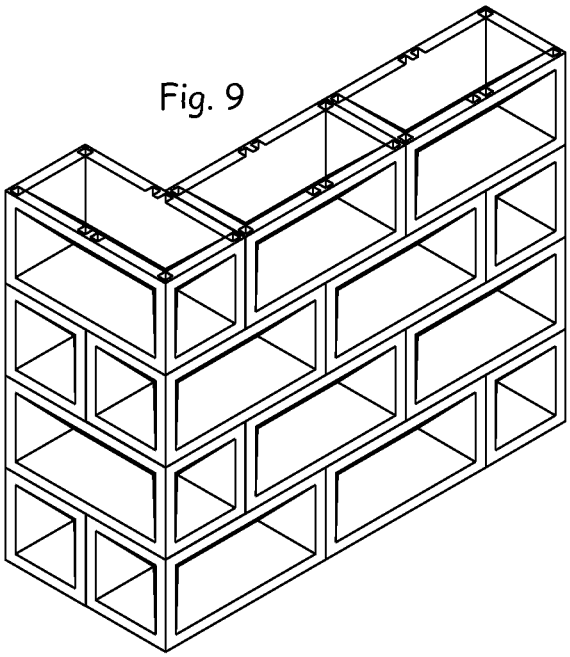
Figure 10:
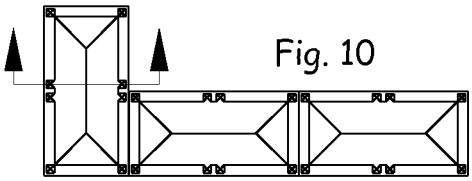
FIG. 10 is a top view of FIG. 9.
Figure 11:
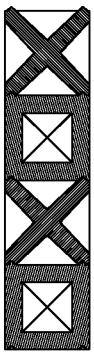
FIG. 11 is a section view taken from FIG. 10.

FIG. 9 is a right angle assembly of the first block variation shown in FIG. 3 and the second block variation shown in FIG. 6. FIG. 10 is a top view of FIG. 9, and FIG. 11 is the section denoted in FIG. 10.

In the interest of clarity the first paragraph will be repeated. "The Gusset Block Construction system invention is comprised of a cube shaped block cored from all 6 sides; a second block that is the same as the first excepting that it is elongated by a factor of 2, and a 3rd octahedral block that fits within the cored out areas of two cubes stacked together holding them in alignment."

Figure 12:
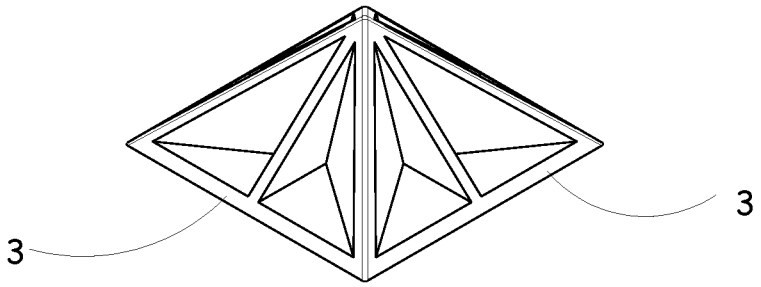
FIG. 12 is an orthogonal view of an octahedral shaped block with 2 of 8 faces, 3 shown.
Figure 13:
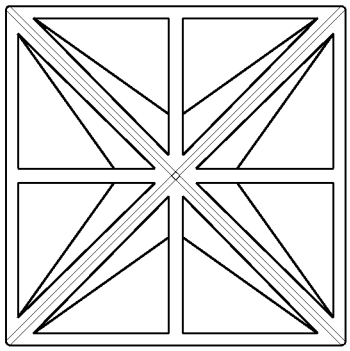
FIG. 13 is a top view of the octahedral shaped block shown in FIG. 12.
Figure 14:
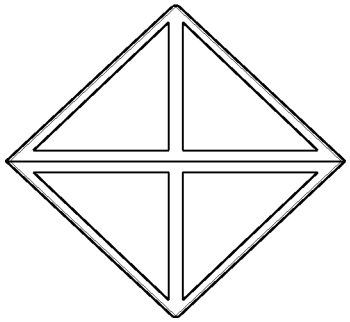
FIG. 14 is a side view of the octahedral shaped block shown in FIG. 12.

The said third octahedral block is an 8 sided block sized to fit the inside of the bottom cored out area of a top block and the inside of the top cored out area of a bottom block in an assembly of a top block, an octahedral block, and a bottom block. FIG. 12 is an injection molded octahedron with the faces, 3, cored to conserve material used and maintain good molding practice. FIG. 13 is a top view of this part and FIG. 14 a side view of the same part. In this block all 8 faces are identical.

Figure 15:
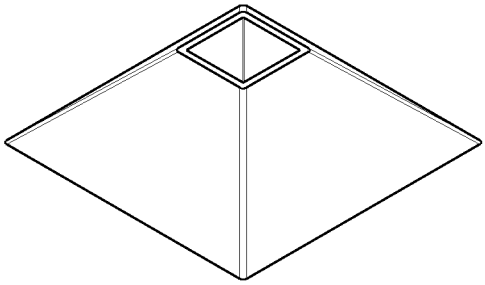
FIG. 15 is an orthogonal view of an ernate octahedral shaped block which is hollow.
Figure 16:
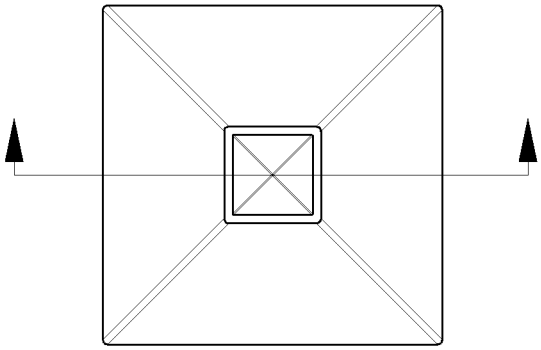
FIG. 16 is a top view of the block in FIG. 15.
Figure 17:
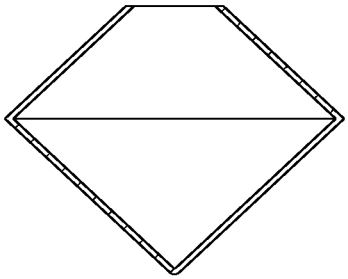
FIG. 17 is a section from FIG. 16 showing the block to be hollow and open at the top.

A second octahedral block is shown in FIG. 15; it is hollow and has an open top to allow for adding sand, water or other material for weight or other properties desired. FIG. 16 is a top view of the octahedral block shown in FIG. 15, and FIG. 17 is a section taken from FIG. 16.

Figure 18:
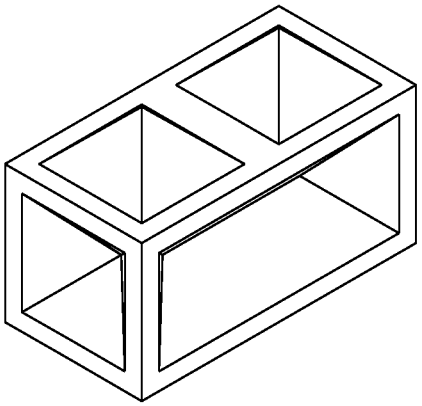
FIG. 18 is an orthogonal view of an elongated block with the top shape of two octahedral shaped blocks molded into the top surface taking away the need for the separate octahedral component.
Figure 19:
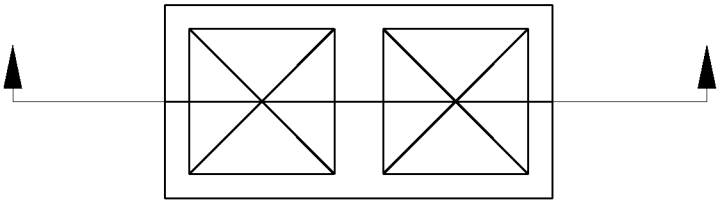
FIG. 19 is a top view of the block shown in FIG. 18.
Figure 20:
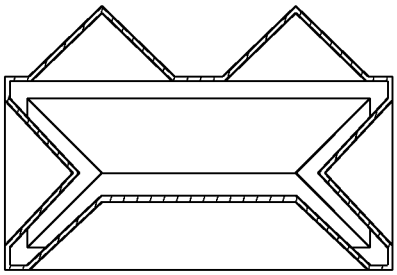
FIG. 20 is a section through the block in FIG. 19 showing it to be hollow.

FIG. 18 is an octahedral view of an elongated block with the top pyramid shaped cores removed and replaced by pyramid shaped projections. FIG. 19 is a top view of the elongated block shown in FIG. 18 and FIG. 20 is a section from FIG. 19. Note in FIG. 18 that the top has projecting pyramids as opposed to indentations. Further note in FIG. 20 that the block is hollow; a block such as this could be blow molded or rotationally molded or molded of structural foam with the hollow area being foam.

Figure 21:
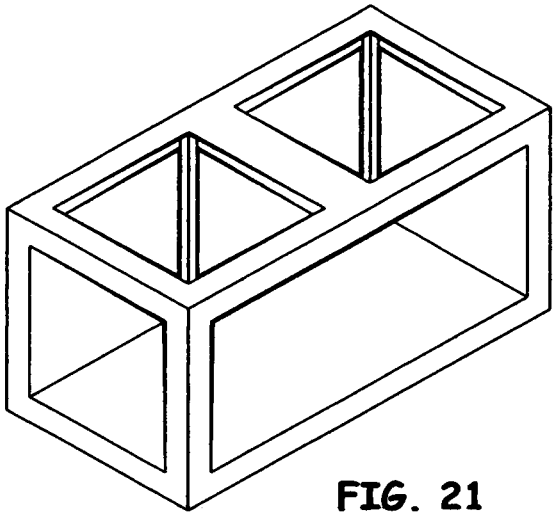
Figure 22:
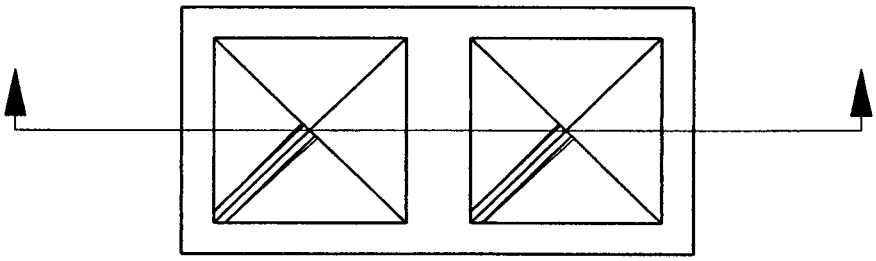
FIG. 22 is a top view of the block in FIG. 21.
Figure 23:
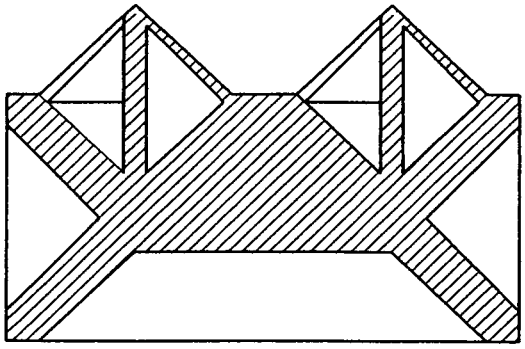
FIG. 23 is a section from FIG. 22.

FIG. 21 is an orthogonal view of an elongated cube shaped block with a configuration on the top surface that will serve as the top surface of a pyramid shaped projection to mate with the bottom pyramid shaped cavity of a block placed on top of it that is cored within the top pyramid shape; to do this two of the pyramid faces have been removed and a gusset 6 serves to provide a pyramid shaped projection surface at the corner where the two removed pyramid faces would have joined. FIG. 22 is a top view of this elongated block and FIG. 23 is a section through FIG. 22. As can be seen in FIG. 23 some additional material would be required to mold this configuration.

Figure 24:
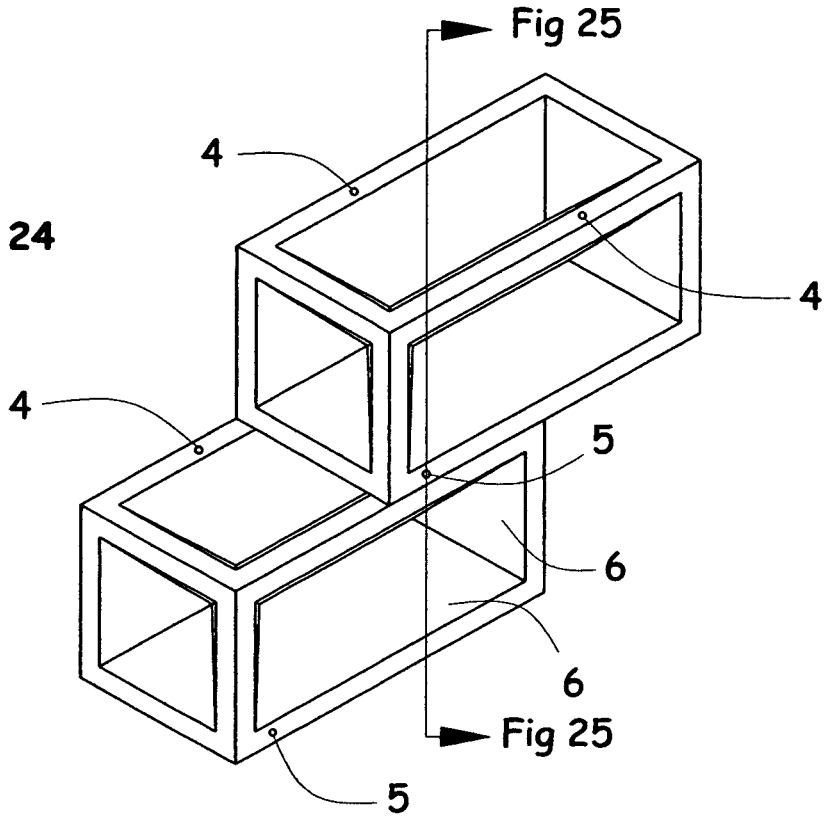
FIG. 24 is a top right orthogonal view of two elongated blocks with molded holes for fastening them together.
Figure 25:
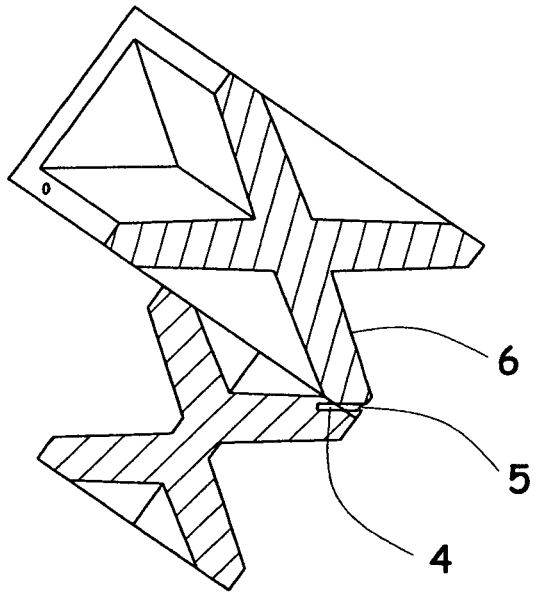
FIG. 25 is a cross section of the two elongated blocks with molded holes from FIG. 24.

FIG. 24 and FIG. 25 are octahedral views of two elongated blocks with holes molded into them; when a fastener is inserted into the holes the blocks are forced into alignment. A hole 4, and a hole 5, referring to FIG. 24 and FIG. 25, can be molded into the block with negligible increase in cost as they are in the axis of mold plate movement. A block of this type might be molded of structural foam or pressed wood composite; or concrete. Further, material permitting, nails can be driven through the surface 6 above the item 5 location, through the block and into the block or other material beneath.

Figure 26:
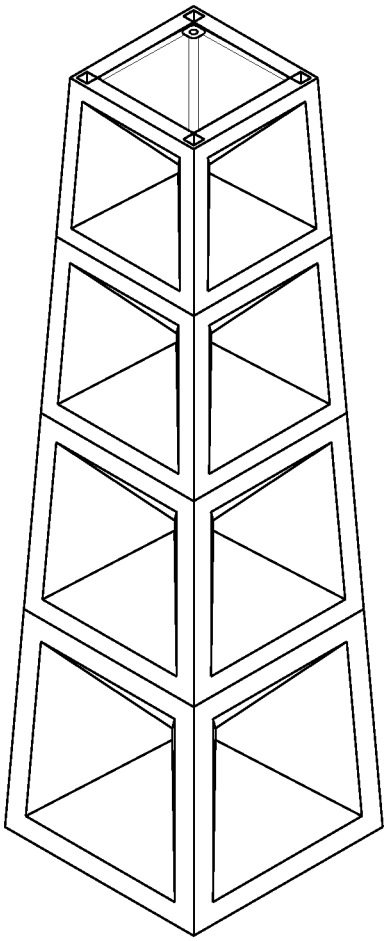
FIG. 26 is an orthogonal view of pier or post made of 4 tapered blocks.

Finally, a last variation of the Construction Block System is the tapered block. These would likely be large and used for piers or posts to support platforms or bridgework. The examples shown will be square and round at the base and tapered from all sides equally but it need not be limited to that; each of these could be elongated as with the elongated block previously shown and also could be tapered on one, two or 3 sides. FIG. 26 is a tapered block 1000 units square at the bottom 1000 units high and 900 units square at the top. The ratio of the top and bottom squares being 900/1000 it follows that if a second block is made 90 percent scale of the first tapered block that the bottom of it will fit the top of the first said tapered block and that if a third block is made 90 percent scale of the second that the bottom of it will fit the top of the second. Further the same holds true for the octahedron parts and or pyramid projections and indentations.

This block could be molded with an axis of mold movement defined by a line from a bottom outside corner that is at central to the 3 planes intersecting at said corner, these 3 planes being defined as a bottom plane that mates with the bottom of said tapered block and two vertical planes that are perpendicular to said bottom plane and to each other.

Figure 27:
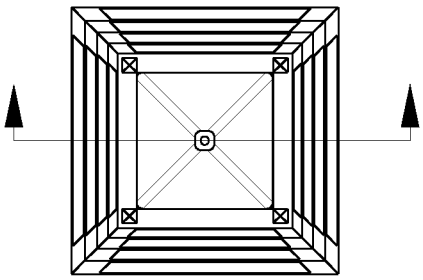
FIG. 27 is a top view of the pier or post shown in FIG. 24
Figure 28:
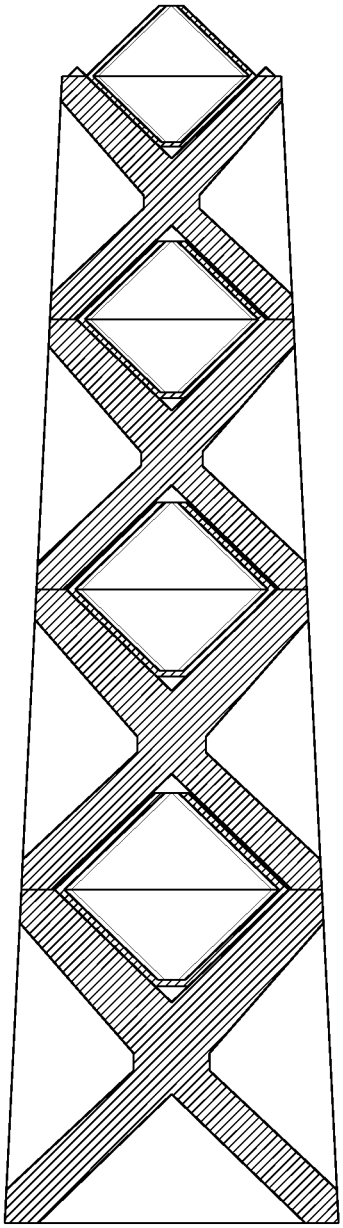
FIG. 28 is a section from FIG. 27.

FIG. 27 is a top view of the assembly in FIG. 26 and FIG. 28 is a section from FIG. 27 showing hollow octahedral parts between individual blocks. Note that a hole is present on the top of each octahedral part so that sand, water, concrete or other material may be put in. It is possible to use the octahedral parts as containers if an inlet and outlet are provided; one hole could serve for both.

Figure 29:
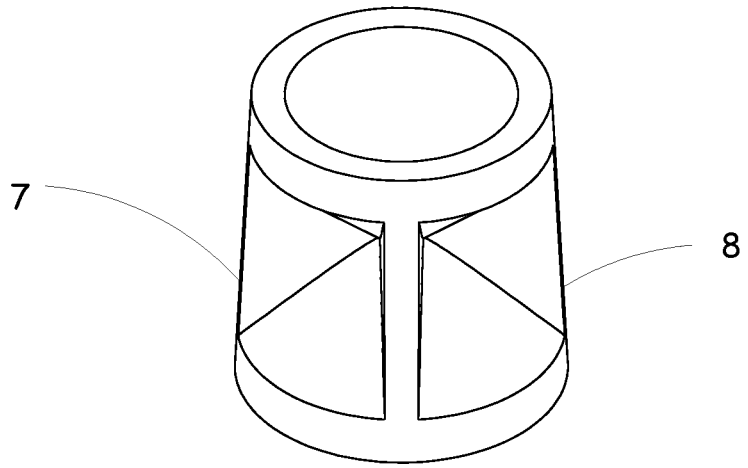
FIG. 29 is an orthogonal view of a frustum of a cone shaped block.
Figure 30:
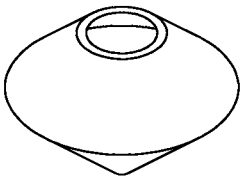
FIG. 30 is a hollow part shaped to fit the top cavity of the frustum of a cone shaped block shown in FIG. 29 and the bottom cavity of a block placed on top of it.
Figure 31:
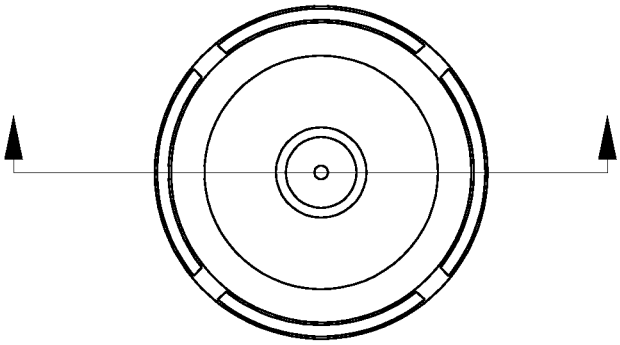
FIG. 31 is a top view of two frustum of cones and a hollow part in assembly.
Figure 32:
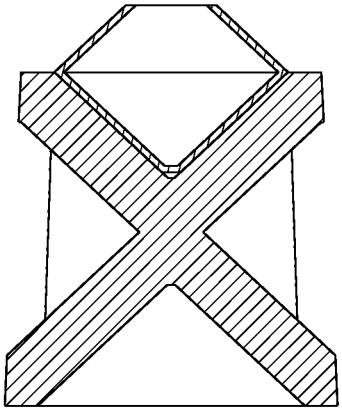
FIG. 32 is a section from FIG. 31.

FIG. 29 is an orthogonal view of a round version of the block shown in FIG. 26. It could be molded in a two piece split mold with and axis of movement determined by a line drawn from the bottom center of a gusset, 7 to top center of the opposing gusset 8. Note that this is essentially the same as used with the square base tapered block. The octahedral insert used in flat plane blocks described previously is replaced by a conical insert and an example is shown in FIG. 30. FIG. 31 is a top view of the conical frustum shown in FIG. 29 with the part shown in FIG. 30 placed in the cavity on the top face; FIG. 32 is a section from FIG. 31.

What is claimed is:

1. A set of building blocks useful for constructing toys or structures comprised of:

a first block, which is a cube; and on each face of said cube a square with the sides of the said square equidistant from the edges of each face; and square serving as the base of a pyramid shaped void projecting into each face of said cube; and, a second block, which is an elongated cube that has a width and height equal to said first block's and a length that is twice as long; each end face has a square on it, the sides of which are the same distance from the edges of said face as on said first block; said square serving as the base of a pyramid shaped void which is the same as that on said part; and further each longer face of this second block has a rectangle on it whose sides are the same distance from the edges of the face as the sides of said square's to the edges of the face on the square ends, said rectangles serving as the base of an elongated pyramid shaped void with base angles the same as those on the pyramid shaped voids on said end faces; and further a third part, a block insert having an octahedral shape defined by the shape of the void between one first block stacked on another first block with edges in alignment; and further;

when one cube shaped block is on top of another with a block insert in between, said cubes will be aligned on their six external faces; and further a first group of three of said second blocks are laid end to end on a level surface; and at one end of this first group, a second group of three of said second blocks are laid end to end in a direction that is perpendicular to the first group to form the first level of an L-shaped wall; and twelve inserts are positioned in the voids on the tops of the blocks of this first level; and a second L-shaped level with two cube shaped blocks and five second blocks are positioned on top of the first level, forming and L-shaped wall that is two levels high; where gravity holds the blocks together in an assembly and in alignment with the planes perpendicular and, horizontal to earth and should they part a distance, which is less than the height of the block insert projecting from the block beneath, due to an external force, the assembly is adapted to return to the original position.

2. The block set in claim 1 in which the said third parts are hollow and have an open end at the top for sand, water or other material to be added.

3. The block set in claim 1 in which protrusions are molded onto at least one face of each block and indentations are positioned into the opposing at least one face of each block, such that when blocks are stacked with faces aligned as in claim 1, said protrusions fit into said indentations and said blocks are in alignment; further said protrusions and indentations are conical or pyramid-shaped; and should the stacked blocks part a distance that is less than the height of said protrusions, due to an external force, the stacked blocks are adapted to return to their original position.

4. The block set in claim 1 in which a first set of holes are molded through the front and back faces of a block external to the pyramid core removed, near the bottom, with a center axis parallel to the axis of mold movement and a second set of holes that are not through holes but to a given depth molded into the top face in alignment with said first holes such that when screws or other fasteners are inserted through said first holes in a top block and into said second holes in a block beneath it the two blocks will be aligned.

5. The block set in claim 1 in which a block can be attached to another block beneath it by driving a nail through the inside surface of the lower gusset shape and through it and into the upper gusset shape on the block beneath it such attachment also being possible on the ends.

* * * * *